US005980223A

United States Patent [19]

Iversen et al.

[11] Patent Number: 5,980,223

[45] Date of Patent: Nov. 9, 1999

[54] REFRIGERANT COMPRESSOR HAVING AN ASYMMETRICALLY CONTOURED PISTON

[75] Inventors: Frank Holm Iversen, Padborg; Michael Skovgaard Jensen, Sønderborg, both of Denmark

[73] Assignee: Danfoss Computers GmbH, Flensburg, Germany

[21] Appl. No.: 08/945,816

[22] PCT Filed: Apr. 26, 1996

[86] PCT No.: PCT/DK96/00189

§ 371 Date: Oct. 27, 1997

§ 102(e) Date: Oct. 27, 1997

[87] PCT Pub. No.: WO96/34200

PCT Pub. Date: Oct. 31, 1996

[30] Foreign Application Priority Data

Apr. 28, 1995 [DE] Germany ..... 195 15 217

[51] Int. Cl.[6] ..... F04B 39/10

[52] U.S. Cl. ..... 417/569; 92/181 R

[58] Field of Search ..... 417/569, 570; 92/181 R, 172

[56] References Cited

U.S. PATENT DOCUMENTS

| | | | |
|---|---|---|---|
| 1,012,725 | 12/1911 | Shadall | 417/569 |
| 1,355,367 | 10/1920 | Towle | 92/181 R |
| 1,972,204 | 9/1934 | Schoene | 92/181 R |
| 2,626,102 | 1/1953 | Garland | 417/569 |
| 2,898,890 | 8/1959 | Lynott | 92/181 R |
| 4,164,915 | 8/1979 | Kulhavy et al. | 123/259 |
| 4,723,896 | 2/1988 | Fritchman | 417/571 |
| 5,149,254 | 9/1992 | Riffe | 417/569 |
| 5,174,735 | 12/1992 | Gannaway | 417/550 |

*Primary Examiner*—Charles G. Freay
*Assistant Examiner*—Robert Z. Evora
*Attorney, Agent, or Firm*—Lee, Mann, Smith, McWilliams, Sweeney & Ohlson

[57] ABSTRACT

A refrigerant compressor has a reciprocating piston with a projection extending therefrom is disposed in a cylinder. The cylinder has an end wall with a discharge opening operably closeable by a discharge valve. The projection is disposed on an end face of the piston and extends into the opening of the discharge valve when the piston is in the region of its end position. Extending the projection into the discharge valve enables gas remaining in the region above the piston and in the region of the discharge opening to be displaced out of the discharge valve. The projection has an asymmetrical construction with a circumferential wall has a gradient changing along the circumference of the wall. The discharge valve seat and the flow channel in the region of the discharge valve are operably contoured to prevent turbulent flow from occurring when gas is discharged from the discharge valve.

14 Claims, 2 Drawing Sheets

REFRIGERANT COMPRESSOR HAVING AN ASYMMETRICALLY CONTOURED PISTON

BACKGROUND OF THE INVENTION

The invention relates to a refrigerant compressor having a piston, which is movable back and forth in a cylinder, the cylinder having at its end wall a discharge opening closable by a discharge valve, into which opening a projection on the corresponding end face of the piston projects when the piston is located in the region of its end position.

Refrigerant compressors of that kind are widely used in domestic refrigerators and upright and chest freezers. In a situation of increasing environmental awareness, there have for some years been attempts to make such cooling devices of lower and lower energy consumption. Saving of energy can be achieved on the one hand by improved heat insulation, and on the other hand also by increasing the efficiency of the refrigerant compressors.

One method of increasing efficiency is to construct at the end face of the piston a projection which, in the region of the upper dead centre of the piston, that is to say when the end face of the piston is as close as possible to the end wall of the cylinder, projects into the discharge opening. By means of this projection the volume of gas remaining in the discharge opening is displaced. Without that projection, the volume of gas remaining there would merely be compressed and could subsequently expand again, which leads to energy loss because of a non-adiabatic process in the refrigerant. Such a projection is known, for example, from the compressor, type SC, manufactured by Danfoss. A similar arrangement is known from U.S. Pat. No. 5,149,254.

The projection has the disadvantage, however, that it affects the flow of the refrigerant through the discharge opening. In particular, in the end region of the movement the cross-section available for the flow can become relatively small, so that the gas flowing through is accelerated. The temperature of the gas rises correspondingly. After flowing through the discharge valve, eddies frequently form in the flow of gas, which lead to an increase in the impedance, causing higher energy consumption.

The invention is based on the problem of increasing the efficiency of a compressor.

SUMMARY OF THE INVENTION

That problem is solved in a refrigerant compressor of the kind mentioned in the introduction in that the projection is of asymmetrical construction in cross-section.

By means of this relatively simple measure, the projection can be better matched to the flow of gas through the discharge opening. Through appropriate shaping of the projection, the flow of gas can be deliberately controlled so that fewer eddies occur and the gap that forms on movement of the piston into its end position between projection and discharge opening maintains a free flow cross-section which is sufficient to allow the gas to flow through without undue resistance. The residual volume in the discharge opening can nevertheless be kept approximately as small as it was previously with a symmetrical projection.

In that case it is especially preferred for the projection to have a sloping circumferential wall, the gradient changing along the circumference. The desired asymmetry of the projection can be achieved relatively easily by such a change in the gradient. The gradient can be matched to the flow of gas to be expected in an individual case, so that it is possible to achieve the desired improvement in the flow characteristic using simple means.

The projection preferably has a gently sloping flank in the direction of a main gas flow. This gently sloping flank causes a relatively gentle redirection of the gas flow, so that formation of eddies is largely avoided by that measure. Even by a gently sloping flank the gas flow is nonetheless guided into the discharge opening. The projection is able to displace the gas volume located in the discharge opening.

In that case it is especially preferred for the projection to be arranged eccentrically on the piston end face and to have the gently sloping flank towards the middle of the piston end face. For various reasons it may be desirable to arrange the projection eccentrically with respect to the end face of the piston. In that case, the main flow of gas will be expected to be approximately from the middle of the piston. In addition, there are, of course, further components which flow from other edge regions of the piston towards the projection. The gradient can be oriented so that the main flow component is disturbed as little as possible.

The projection preferably has a steep flank opposite the gently sloping flank. If the gently sloping flank is defined as the front side, the steep flank forms the rear side. This improves the flow characteristic over the projection. In particular, the risk that a part of the flow at the "rear" of the projection will not flow out through the discharge opening but will flow under the projection, is low.

In that case it is especially preferred for the steep flank to run substantially parallel to the wall of the cylinder. Tests have shown that the best results can be achieved by that measure.

In a preferred construction, provision is made for the end wall of the cylinder to have an oblique face in a region opposite the gently sloping flank. The end wall of the cylinder is therefore matched in that region to the shape of the projection. As a result, as the piston moves towards the end wall of the cylinder, a flow channel having favourable flow properties is formed.

The basal area of the projection is preferably larger than the discharge opening. Despite the chamfer, the projection is able to fill the discharge opening satisfactorily and displace the gas located therein.

It is also preferred for the oblique face to run substantially parallel to the gently sloping flank. Both faces together, that is, the oblique face and the sloping flank, are therefore able to form a channel which determines the flow direction of the gas. The desired angle can be determined taking into account further marginal constraints.

The projection preferably has an end face which runs substantially parallel to a face acted upon by a sealing face of the discharge valve. The space in which gas which is not displaced by the piston, or rather by the projection, is still able to collect, can thus be kept very small.

It is also preferred for the discharge valve to have a valve seat, of which the axis is inclined with respect to the axis of the cylinder. The discharge valve is therefore inclined. In particular in combination with the sloping flank and/or the end face of the projection that runs parallel to the face acted upon by the valve seat, a flow characteristic in which the gas flows virtually eddy-free through the discharge valve can be achieved by this means.

Furthermore, it is advantageous for a discharge chamber to be arranged beyond the discharge valve, viewed in the flow direction, which chamber extends substantially in one direction on the side of the discharge opening remote from the cylinder. The tendency of the gas to eddy is also reduced as a result of that measure.

The flow through the discharge valve is preferably substantially such that the component of the flow parallel to the closure element of the discharge valve runs substantially in a single direction. In the case of the component at right angles to the closure part, this precondition was already previously fulfilled. Otherwise the gas would be unable to flow through the discharge valve. In customary constructions, however, after passing through the valve the gas spread out radially with respect to the valve, so that at least in some regions considerable turbulence of the gas was observed. The new construction causes the gas to flow virtually in a single direction, so that the risk of turbulence forming is much reduced.

In this case it is especially preferred for that direction to form an acute angle with the end wall of the cylinder. The gas, which flows in particular in the end phase of the movement of the piston substantially parallel to the cylinder wall, then needs to change its direction during and after flowing through the discharge valve only slightly.

BRIEF DESCRIPTION OF THE DRAWINGS

The invention is described hereinafter with reference to preferred embodiments in conjunction with the drawings, in which.

DESCRIPTION OF EXAMPLE EMBODYING THE BEST MODE OF THE INVENTION

To explain the problem posed, first of all a refrigerant compressor according to the prior art will be explained with reference to FIG. 1.

Figure 1:
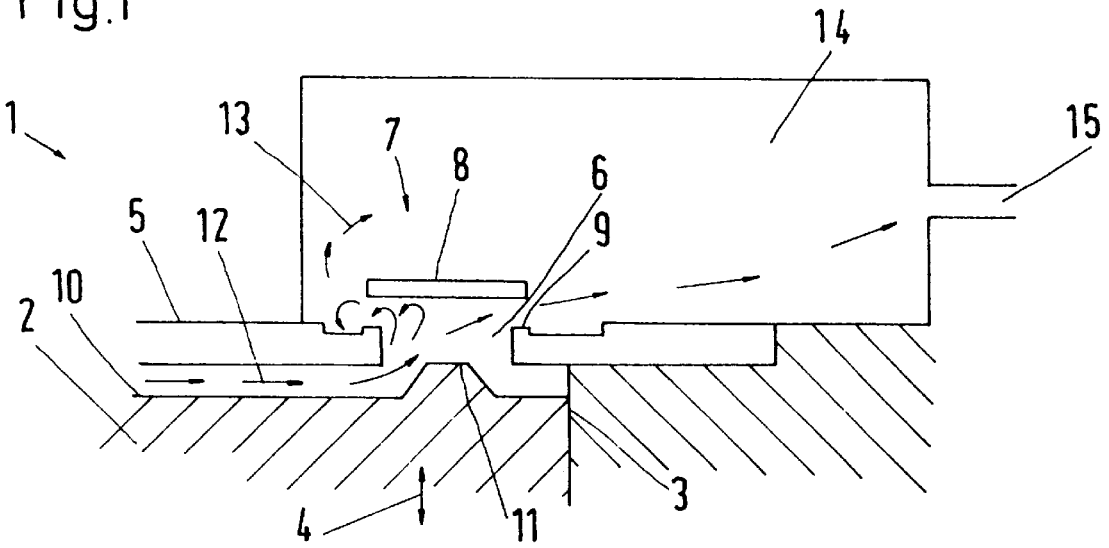
FIG. 1 is a diagrammatic section through a compressor according to the prior art.

FIG. 1 shows a refrigerant compressor 1 having a piston 2 which is movable back and forth in a cylinder 3 in the direction of a double arrow 4.

The cylinder 3 is closed at its end by an end wall 5, in which there is a discharge opening 6. The discharge opening 6 can be closed by a discharge valve 7 which has a closure element 8 which can be brought into engagement with a valve seat 9 which surrounds the discharge opening 6.

The piston 2 has on its end face 10 a projection 11 in the form of a truncated cone. When the piston 2 is moved towards the end wall 5 of the cylinder 3, the projection 11 is introduced into the discharge opening 6 and contributes to displacing the volume of gas located there. In this manner, a dead space in which otherwise the gas would be only compressed, but not displaced from, is kept as small as possible.

Arrows 12 indicate a flow of gas, which develops when the piston 2 is moved towards the end wall 5 of the cylinder 3. The projection 11 diverts the gas flow in certain regions so that eddies, indicated by arrows 13, form. These eddies increase the impedance, and therefore necessitate additional effort to drive the gas through the valve. Moreover, in the known refrigerant compressor 1, the channels that form in the final stages of the approach of the piston 2 to the end wall 5 are really quite narrow, and lead to a marked increase in the speed of the gas flow, which in turn results in a rise in the temperature of the gas.

Viewed in the flow direction, beyond the valve there is arranged a discharge chamber 14, which is connected by way of a connection 15 to a noise-suppressor or a pressure outlet of the refrigerant compressor.

Figure 2:
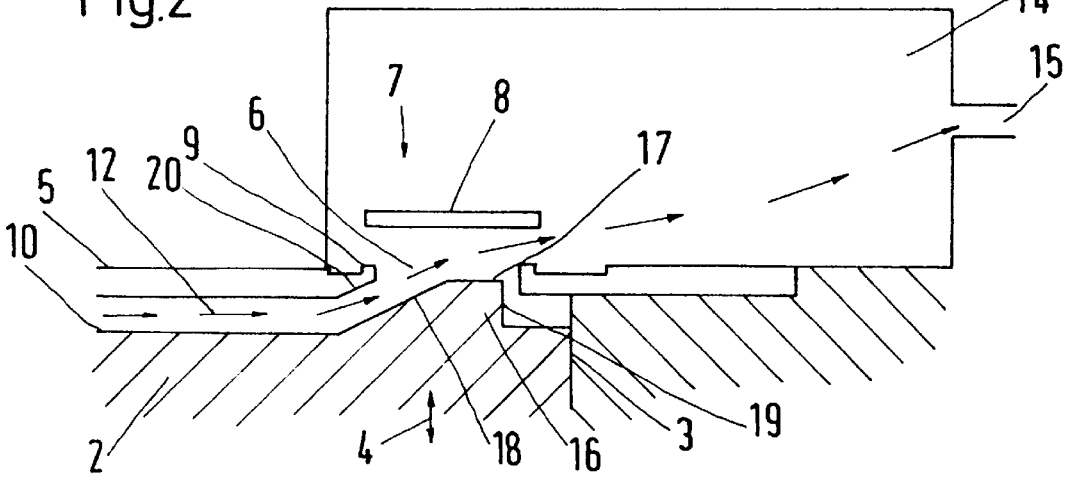
FIG. 2 is a section through a first embodiment of the invention.

In order to reduce losses in the region of the discharge valve and thus to increase the efficiency of the refrigerant compressor, the form of the projection is changed, as illustrated, for example, in FIG. 2. In FIG. 2, identical parts have been provided with identical reference numerals.

Compared with FIG. 1, a different projection 16 is used. The projection 16 is no longer symmetrical, like the projection 11 in FIG. 1, but asymmetrical. It has an end face 17 which runs substantially parallel to the end face 10 of the piston 2. From this end face 17 a gently sloping flank 18 extends towards the end face 10 of the piston 2, namely, in the direction from which the main gas flow, again indicated by arrows 12, is expected. On the opposite side (or rear side), there is a steep flank 19, which runs substantially parallel to the wall of the cylinder 3. The flanks 18, 19 can be formed by a common circumferential wall which is inclined with respect to the end face 10 of the piston 2, the gradient changing in the circumferential direction. The gradient or steepness is greatest in the region of the steep flank 19 and least in the region of the gently sloping flank 18.

A further modification is found in the end wall 5 of the cylinder. There, opposite the gently sloping flank 18 there is provided a oblique face 20 which runs substantially parallel to the gently sloping flank 18.

This construction of the projection 16 now allows gas to flow through the valve 7 virtually free from turbulence. If the gas flow is split up into components at right angles and parallel to the end face 10 of the piston 2, the component parallel to the end face is virtually all in a single direction.

This flow characteristic is further improved by two factors. As is apparent from FIG. 2, the projection 16 is arranged close to the wall of the cylinder 3. The projection 16 is therefore arranged eccentrically with respect to the piston 2. As the gas is compressed, a flow is generated which, viewed from the projection 16, has a main component that comes from the direction of the mid-point of the piston 2. The discharge chamber 14 extends radially (in relation to the piston) exactly in the opposite direction from the discharge opening 6, so that the gas flow is able to pass through the discharge valve 7 virtually without excessive change in direction. The small change in direction necessary is effected very carefully by the gently sloping flank 18.

Figure 3:
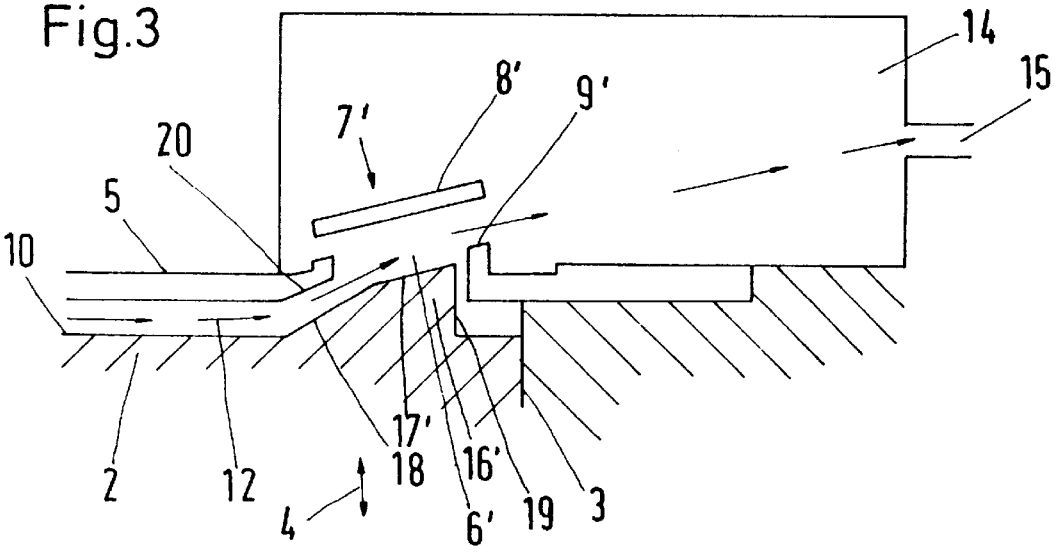
FIG. 3 is a section through a second embodiment of the invention and FIG. 4 is a perspective view of part of a compressor.

FIG. 3 shows a further construction, in which parts that correspond to those of FIG. 2 have been provided with the same reference numerals. Modified elements are provided with primed reference numerals.

Modifications made compared with the embodiment shown in FIG. 2 are as follows: the valve seat 9' is no longer arranged parallel to the end face 10 of the piston 2, but is inclined, so that the area that it acts upon forms an acute angle with the end face 10 of the piston 2. In other words: the axis of the discharge opening 6' forms an acute angle with the axis of the piston 2 which runs parallel to the direction illustrated by the double arrow 4. Accordingly, the closure element 8' is also arranged sloping correspondingly. The end face 17' of the projection 16' is arranged, as before, parallel to the closure element 8'. It too is accordingly inclined with respect to the end face 10 of the piston 2.

An even better control of the gas flow through the discharge valve 7' can be achieved with this construction. In this manner a flow channel for the outflowing gas can be created which, substantially for its entire length, at least as far as the valve 7' is concerned, maintains a constant cross-section. The efficiency of the compressor is thereby further improved.

Figure 4:
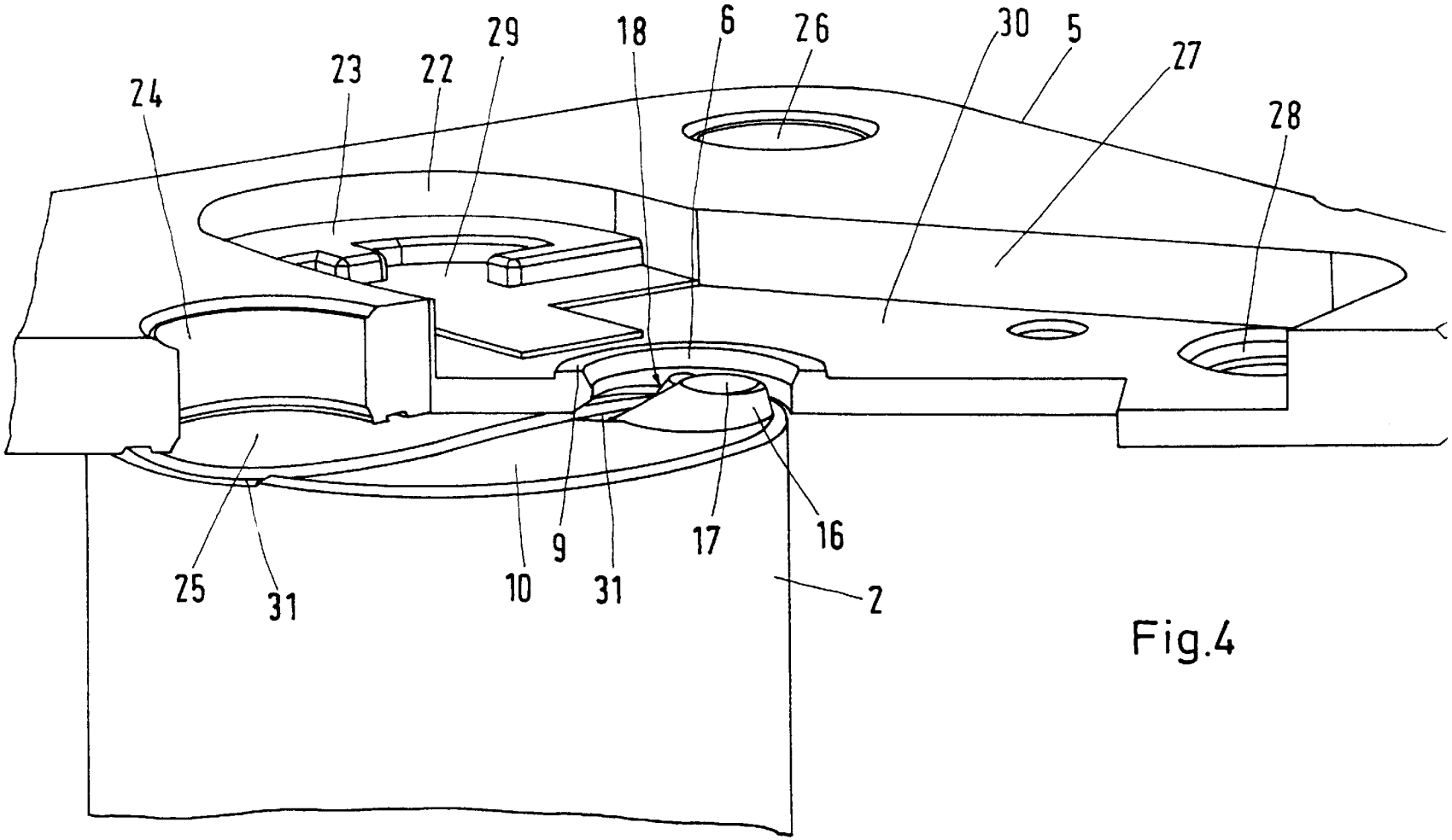

FIG. 4 shows in perspective an arrangement such as that illustrated diagrammatically in FIG. 2. The end wall 5 of the cylinder is here in the form of a valve plate. It extends laterally beyond the piston 2.

On the side of the end wall 5 remote from the piston 2 there is a recess 22 having several steps. The lowest step 30 lies in a plane below the valve seat 9. The valve seat 9 therefore stands proud. The closure element 8, not shown in FIG. 4, when resting on the valve seat 9, does not lie at the same time on the lowest step 30, so that accidental adhesion, encouraged, for example, by an oil film, is avoided.

The closure element 8 will accordingly lie on a second step 29, the height of which is approximately the same as the height of the valve seat 9 above the lowest step 30. Furthermore, yet a third step 23 is present, to which a bridge-like stop member, likewise not illustrated, for the closure element 8 can be secured. The bridge-like stop member controls the maximum travel of the closure element 8.

The gently sloping flank 18 of the projection 16 is directed towards the mid-point of the end face 10 of the piston 2.

Also illustrated in FIG. 4 is a suction opening 24 with a suction valve 25. The suction valve 25 lies in a recess 31 in the end face 10 of the piston. The recess 31 has a small clearance along the edges of the main valve 25. This produces channels which serve as gas guide ducts for discharge of the gases.

Finally, a mounting hole 26 intended for the insertion of a screw bolt or other fixing element is illustrated in the end wall 5.

Furthermore, a bore 28 to which the connection 15 from the discharge chamber 14 can be connected, can be seen. The discharge chamber 14 is surrounded by a wall 27 which also includes the bore 28, so that the gas flowing out of the valve 7 can be conveyed to the connection 15.

The refrigerant compressor can, of course, also be constructed with several discharge valves, with the result that an optimum gas flow can be achieved by an asymmetrical arrangement of the projections 16 which project into the discharge openings 6. The smaller are the losses in the gas flow, the greater is the efficiency of the compressor.

We claim:

1. A refrigerant compressor having a piston which is movable back and forth in a cylinder, the cylinder having at its end wall a discharge opening closable by a discharge valve, the piston having a projection on an end face which projects into the opening when the piston is located in the region of its end position, and the projection being of asymmetrical construction in cross-section.

2. A compressor according to claim 1, in which the projection has a sloping circumferential wall having a gradient changing along the circumference of the wall.

3. A compressor according to claim 1, in which the projection has a gently sloping flank in the direction of a main gas flow.

4. A compressor according to claim 3, in which the end wall of the cylinder has an oblique face in a region opposite the gently sloping flank.

5. A compressor according to claim 4 in which the projection has a basal area which is larger than the discharge opening.

6. A compressor according to claim 4 in which the oblique face extends substantially parallel to the gently sloping flank.

7. A compressor according to claim 3, in which the projection is arranged eccentrically on the piston end face and has the gently sloping flank extending toward the middle of the piston end face.

8. A compressor according to claim 7, in which the projection has a steep flank opposite the gently sloping flank.

9. A compressor according to claim 8, in which the steep flank extends substantially parallel to the wall of the cylinder.

10. A compressor according to claim 1 in which the projection has an end face which is substantially parallel to a sealing face of the discharge valve.

11. A compressor according to claim 1 in which the discharge valve has a valve seat having an axis inclined with respect to an axis of the cylinder.

12. A compressor according to claim 1, in which a discharge chamber is located beyond the discharge valve, viewed in the flow direction, which chamber extends substantially in one direction on a side of the discharge opening remote from the cylinder.

13. A compressor according to claim 1, in which flow through the discharge valve is substantially parallel to a closure element of the discharge valve, and the flow extends substantially in a single direction.

14. A compressor according to claim 13, in which said direction forms an acute angle with the end wall of the cylinder.

* * * * *

UNITED STATES PATENT AND TRADEMARK OFFICE

CERTIFICATE OF CORRECTION

PATENT NO. : 5,980,223

DATED : November 9, 1999

INVENTOR(S) : Frank H. Iverson, et al

It is certified that error appears in the above-identified patent and that said Letters Patent is hereby corrected as shown below:

On the title page: Item [73] Assignee:

"Danfoss Computers GmbH" should read -- Danfoss Compressors --.

Signed and Sealed this

Second Day of January, 2001

*Attest:*

*Attesting Officer*

Q. TODD DICKINSON

*Commissioner of Patents and Trademarks*